US011070928B2

(12) United States Patent
Meier et al.

(10) Patent No.: US 11,070,928 B2
(45) Date of Patent: Jul. 20, 2021

(54) HEARING DEVICE AND A METHOD FOR MANUFACTURING THEREOF

(71) Applicant: Sonova AG, Stafa (CH)

(72) Inventors: Hilmar Meier, Herrliberg (CH); Andre Lucien Ochsenbein, Bubikon (CH); Leo Den Hartog, Zurich (CH); Christian Frei, Stafa (CH); Daniel Probst, Uerikon (CH); Gabriel Perez, Mannedorf (CH); Paul Bechtiger, Meilen (CH)

(73) Assignee: SONOVA AG, Stäfa (CH)

( * ) Notice: Subject to any disclaimer, the term of this patent is extended or adjusted under 35 U.S.C. 154(b) by 35 days.

(21) Appl. No.: 16/338,081

(22) PCT Filed: Sep. 29, 2016

(86) PCT No.: PCT/EP2016/073216
§ 371 (c)(1),
(2) Date: Mar. 29, 2019

(87) PCT Pub. No.: WO2018/059688
PCT Pub. Date: Apr. 5, 2018

(65) Prior Publication Data

US 2020/0252735 A1 Aug. 6, 2020

(51) Int. Cl.
*H04R 25/00* (2006.01)
*H04R 31/00* (2006.01)

(52) U.S. Cl.
CPC ..... *H04R 25/65* (2013.01); *H04R 25/554* (2013.01); *H04R 31/00* (2013.01); *H04R 25/60* (2013.01);

(Continued)

(58) Field of Classification Search
CPC ..... H04R 25/554; H04R 25/609; H04R 2225/51; H04R 2225/023; H04R 2225/49; H04R 2225/025
See application file for complete search history.

(56) References Cited

U.S. PATENT DOCUMENTS 8,401,211 B2 * 3/2013 Angst ..... H04R 25/556 381/312
8,494,197 B2 * 7/2013 Polinske ..... H04R 25/602 381/315

(Continued)

FOREIGN PATENT DOCUMENTS

EP 1 227 434 A1 7/2002
EP 2 200 119 A2 6/2010

(Continued)

OTHER PUBLICATIONS

International Search Report for PCT/EP2016/073216 dated May 26, 2017.
Written Opinion for PCT/EP2016/073216 dated May 26, 2017.

*Primary Examiner* — Sunita Joshi
(74) *Attorney, Agent, or Firm* — Pearne & Gordon LLP

(57) ABSTRACT

A hearing device to be worn in or at the ear of a user. The hearing device includes a housing for accommodating an electronic component, wherein the housing includes an electromagnetic wave shielding material and is formed with an indentation. The indentation provides a space at the outer side of the housing, allowing an antenna to be inserted into the indentation. The proposed hearing device achieves improved shielding of the antenna against electromagnetic waves radiated from at least one of the electronic components.

18 Claims, 2 Drawing Sheets

(52) U.S. Cl.
CPC ..... *H04R 25/609* (2019.05); *H04R 2225/023* (2013.01); *H04R 2225/025* (2013.01); *H04R 2225/49* (2013.01); *H04R 2225/51* (2013.01); *H04R 2225/57* (2019.05)

(56) References Cited

U.S. PATENT DOCUMENTS

| | | | | |
|---|---|---|---|---|
| 2008/0056520 | A1* | 3/2008 | Christensen | H01Q 1/44 381/323 |
| 2011/0051965 | A1* | 3/2011 | Beck | H04R 25/65 381/322 |

FOREIGN PATENT DOCUMENTS

| | | | |
|---|---|---|---|
| EP | 3 038 382 | A1 | 6/2016 |
| WO | 97/21325 | A1 | 6/1997 |
| WO | 2008/141677 | A1 | 11/2008 |
| WO | 2013/135307 | A1 | 9/2013 |

* cited by examiner

HEARING DEVICE AND A METHOD FOR MANUFACTURING THEREOF

TECHNICAL FIELD

The present invention is related to a hearing device and a method for manufacturing a hearing device to be worn in or at the ear of a user.

BACKGROUND OF THE INVENTION

Hearing devices are typically used to improve the hearing capability or communication capability of a user. A hearing device may pick up the surrounding sound with a microphone of the hearing device, processing the microphone signal thereby taking into account the hearing preferences of the user of the hearing device and providing the processed sound signal into an hearing canal of the user via a miniature loudspeaker, commonly referred to as a receiver. A hearing device may also receive sound from an alternative input such as an induction coil or a wireless interface.

Such hearing devices comprise hearing devices to be worn in or at the ear of a user, for example In-the-Ear (ITE) hearing devices to be worn into the hearing canal of a user. Such ITE hearing devices comprise a housing which is substantially shaped according to the individual contour of the hearing canal of the user, wherein said housing is for accommodating a plurality of electronic components of the hearing device, such as a processor, a battery, a microphone, a receiver, etc. Commonly, the housing of the ITE hearing device is exposed to substantially wear due to moisture, dust and dirt, for example. In order to prolong durability of the housing, ITE hearing devices are known which housings are made of metal, in particular titan.

On the other hand, hearing devices, in particular ITE hearing devices, are known which support wireless connectivity. For instance, it has become increasingly common for a wireless link to be incorporated in hearing devices for various purposes such as receiving information, e.g. as electromagnetically encoded sound information from an induction loop, wireless programming of the hearing device, or for establishing a wireless link between two hearing devices or between one or more hearing devices and a further device. Such hearing devices comprise at least one antenna for transmitting/receiving electromagnetic signals bearing at least hearing device related information.

However, hearing devices comprising both a housing made of metal as well as an antenna disposed inside the metal housing are unknown so far. The reason for this is the shielding capability of the metal made housing, which shielding renders wireless connectivity impossible, since the metallic housing is acting as a Faraday cage permitting electromagnetic waves to pass through the housing. Therefore, wireless communication is not possible if the antenna is placed into the metallic housing.

Further, even in the case of hearing devices which housings are made of a non-shielding material, i.e. a non-ferromagnetic material, such as plastic, natural rubber, silicon, etc., problems occur caused by placing the antenna inside the housing. The reason for this is due to interference induced into the antenna by nearby placed electronic components, for example a processor, receiver, transducer, hybrid, etc. To combat this problem, it is known to increase the distance between the antenna and the one or more respective interfering electronic component inside the hearing device, since interference induced into the antenna decreases with increased distance between the antenna and the respective interfering electronic component. However, the larger the distance between the antenna and the one or more interfering electronic component, the larger is the size of the hearing device. Hence, efforts in reducing the size of hearing devices, in particular small-sized ITE hearing devices, are counteracted.

Further measures commonly applied in order to try to reduce interference induced into the antenna placed inside the housing of the hearing device comprise shielding the electromagnetic wave sensitive antenna, in particular with the aid of an aluminum layer. However, also this solution makes the hearing device to increase in size. Further, the shielding is hard to prepare and therefor time-consuming and cost-effective.

Document WO 2013/135307 A1 relates to an antenna module for a hearing device, wherein the antenna module is placed on one of axial ends of the hearing device housing outside thereof. Hence, this solution proposes to move the antenna away from the circuitry and/or out of the housing of the hearing device and into unused space in the hearing canal. Therefore, the antenna is separated from interference causing components by placing the antenna deep into the hearing canal away from said interference causing components, e.g. the processor of the hearing device. However, this prior art solution is not optimal for long antenna coils with small diameters. Further, due to the placement of the antenna near to the receiver of the hearing device, electromagnetic spikes resulting from digital amplification stages which drive the receiver are coupled into the antenna coil resulting in reduced wireless connectivity or even interruptions thereof.

It is therefore an object of the present invention to provide a hearing device to be worn in or at the ear of a user, which hearing device solves the problems mentioned above. In particular, it is object of the present invention to provide the housing of the hearing device with a durable material as well as to reduce interference coupled into the antenna of the hearing device. It is further object of the invention to propose a method for manufacturing such hearing device.

SUMMARY OF THE INVENTION

The present invention is directed to a hearing device to be worn in or at the ear of a user, said hearing device comprises a housing for accommodating an electronic component of the hearing device, wherein said housing comprises an electromagnetic wave shielding material and is formed with an indentation, said indentation providing a space at the outer side of the housing, wherein said hearing device further comprises an antenna inserted into the indentation.

It should be pointed out, that the hearing device may comprise a microphone, a processor, a receiver and a battery which are contained in a single housing. The hearing device may however comprise multiple housings. Not all of the aforementioned components or modules of the hearing device need to be contained inside the same housing. The housing in the context of this invention is to be understood as the housing of that part of the hearing device which provides mechanical support for the antenna.

Hence, provided is a hearing device to be worn in or at the ear of a user, which housing is made of a durable electromagnetic wave shielding material. The invention further allows to reduce or rather eliminate interference induced into the antenna of the hearing device. The objection is solved in that the electromagnetic wave shielding material simultaneously provides durable characteristics as well as improved shielding characteristics in order to shield the antenna against electromagnetic waves transmitted or rather induced by electronic components placed inside the housing of the hearing device.

In an embodiment the hearing device is to be worn at least partially in the hearing canal of a user, wherein said housing is at least partially shaped according to the individual contour of the hearing canal of the user. Hence, the hearing device can be an ITE hearing device supporting both improved wireless connectivity as well as a durable housing which further prevents entrance of impurities, moisture, etc. The hearing device can also be an BTE (Behind-the-Ear) hearing device with a custom shaped earpiece. The hearing device can further be a custom shaped CIC (Completely-in-Canal) hearing device.

In an embodiment of the proposed hearing device the antenna is comprised by an antenna module further comprising an enclosure for encapsulating the antenna. The proposed embodiment allows the antenna to be completely encapsulated which avoids the antenna to be exposed to the outside. Therefore, the antenna is properly protected.

In an embodiment of the proposed hearing device the enclosure is a cast comprising at least one of resin, natural rubber and silicon. Casting the enclosure by using resin, natural rubber, silicon, etc. allows proper surface treatment of the enclosure. Further, superior surface finishing as well as improved biological compatibility are allowed.

In an embodiment of the proposed hearing device the antenna is integrally casted within the enclosure. In this way, the antenna is properly protected against the environment.

In an embodiment of the proposed hearing device at least a portion of the surface of the enclosure is shaped such to substantially mate with the contour of the indentation. In an example, a modelling software can be run on a computer which provides an optimal position of the antenna out of the shell in order to allow improved fitting-rate for the hearing device user. This modelling software can be supplied with data resulting from measuring the geometry of the hearing canal of the user. An RSM (Rapid Shell Modeling) modelling technology can be used in order to allow proper placement of the antenna outside the hearing device housing. By allowing the enclosure to mate with the contour of the indentation, entrance of impurities, e.g. dust, dirt and moisture, between the portion of the surface of the enclosure facing towards the hearing device housing and the respective (indented) portion of the housing can be largely reduced or rather prevented.

In an embodiment of the proposed hearing device at least a portion of the surface of the enclosure is shaped such to align with the outline of the housing once the enclosure is inserted into the indentation. This solution allows that the whole outer surface of the ITE hearing device housing proper follows the geometry of the hearing canal of the user once inserted. Therefore, the hearing comfort of the ITE hearing device is improved resulting in increased customer satisfaction.

In an embodiment of the proposed hearing device the antenna module comprises at least one fixture means, such as a snap-in mechanism, adapted to engage at least a portion of the hearing device housing. In an example, the fixture means is a snap-in mechanism comprising at least one ledge adapted to snap into associated openings or recesses formed into the housing of the hearing device. In this way, the antenna module can be easily and securely fastened to the housing of the hearing device by simply guiding the ledge into the opening of the housing and letting the ledge to snap into or rather against respective counterparts. Of course, the fixture means can comprise more than one ledge. The at least one ledge can snap into respective recesses formed into the housing of the hearing device and/or can snap against the inner surface of the housing of the hearing device. Hence, the antenna module can be affixed to the housing in a quick and reliable manner.

In a further embodiment of the proposed hearing device the fixture means are integrally formed with a fixing plate bonded to the enclosure. The antenna module and the fixing plate can be casted integrally. Therefore, additional steps for mounting the fixing plate to the enclosure can be omitted. In a further example, the fixture means and/or the fixing plate can be glued to the antenna module.

In a further embodiment of the proposed hearing device the enclosure is glued to a portion of the housing comprising the indentation. By gluing the enclosure to the indented portion of the hearing device housing, a simple and reliable connection is provided. Further, potential gaps between the enclosure and the housing of the hearing device can be prevented due to the application of the glue.

In an embodiment of the proposed hearing device the antenna is molded into the indentation. In this embodiment, since the antenna is molded directly into the indentation, the provision of the enclosure surrounding the antenna module, as mentioned above, can be omitted. This embodiment provides a very simple and reliable way of fixing the antenna to the housing of the hearing device as well as filling the indentation such to proper follow the contour of the housing without leaving gaps. In an example, after the mold is cured, the surface thereof can be surface-treated. Suitable surface treating methods allowing proper surface-finishing of the mold are known to the skilled person.

In an embodiment of the proposed hearing device the housing in a portion of the indentation comprises at least one through-hole for routing at least one electrical conductor for electrically connecting the antenna to at least one of the electronic components. In an example, the routing of the at least one electrical conductor can be performed such to follow the shortest path. Advantageously, the through-hole is protected against the environment by means of the enclosure or the mold once the antenna is molded into the indentation. Hence, entrance of moisture into the housing via the through-hole is prevented.

In an embodiment of the proposed hearing device the electromagnetic wave shielding material comprises a metal, in particular titan. Using a metal, in particular titan, allows to provide a housing exhibiting enhanced strength and durability as well as excellent electromagnetic wave shielding properties against electromagnetic waves in order to dampen or eliminate interference between the antenna placed outside and at least one of the electronic components placed inside the housing. Due to the placement of the antenna at least outside the housing, wireless communication between the antenna and at least one associated transmitter/receiver remote from the hearing device remains stable.

Moreover, the present invention is directed to a method for manufacturing a hearing device to be worn in or at the ear of a user, said method comprises the steps of: providing a housing of the hearing device, said housing comprising at least one electromagnetic wave shielding material; forming the housing with an indentation, said indentation providing a space at the outer side of the housing; inserting an antenna into the indentation; and fixing the antenna to at least a portion of the housing comprising the indentation. The inventive method allows to manufacture a hearing device exhibiting excellent strength and durability, e.g. against moisture. Further, interference between the antenna and at least one electronic component inside the hearing device is avoided due to the metal is acting as a Faraday cage such to shield the antenna against electromagnetic waves emitted by the at least one electronic component placed inside the hearing device housing.

In an embodiment of the proposed method the providing step comprises the step of shaping the housing of the hearing device such to at least partially mate with the individual contour of the hearing canal of the user. Therefore, the hearing device gently fits to the individual hearing canal of the user and is comfortable to wear.

In an embodiment of the proposed method the fixing step comprises the steps of encapsulating the antenna within an enclosure, and mounting the enclosure to the portion of the housing comprising the indentation. Therefore, the antenna can be properly sealed against the environment. In other words, the antenna is protected against dust, dirt and/or moisture in a very reliable way. At least one respective antenna cable can be routed such to extend outside the enclosure. Further, said cable can be routed into the hearing device through a trough-hole of the hearing device housing.

In an embodiment the proposed method further comprises the step of shaping at least a portion of the surface of the enclosure such to substantially mate with the contour of the indentation. The method allows to provide a hearing device which can be worn inside the hearing canal of the user in a very comfortable way. The shaping step can comprise machining, e.g. grinding, the enclosure surface such to smoothly follow the contour of the hearing device housing.

In an embodiment the method further comprises the step of shaping at least a portion of the surface of the enclosure such to substantially align with the contour of the surface of the housing once the enclosure is inserted into the indentation.

In an embodiment of the proposed method the fixing step comprises the steps of molding the antenna within the indentation by means of a mold, and surface-treating the mold such to substantially align with the contour of the surface of the housing.

It is expressly pointed out that any combination of the above-mentioned embodiments is subject of further possible embodiments. Only those embodiments are excluded that would result in a contradiction.

BRIEF DESCRIPTION OF THE DRAWINGS

The present invention is further described with reference to the accompanying drawings jointly illustrating various exemplary embodiments which are to be considered in connection with the following detailed description. What is shown in the figures is.

DETAILED DESCRIPTION OF THE INVENTION

Figure 1:
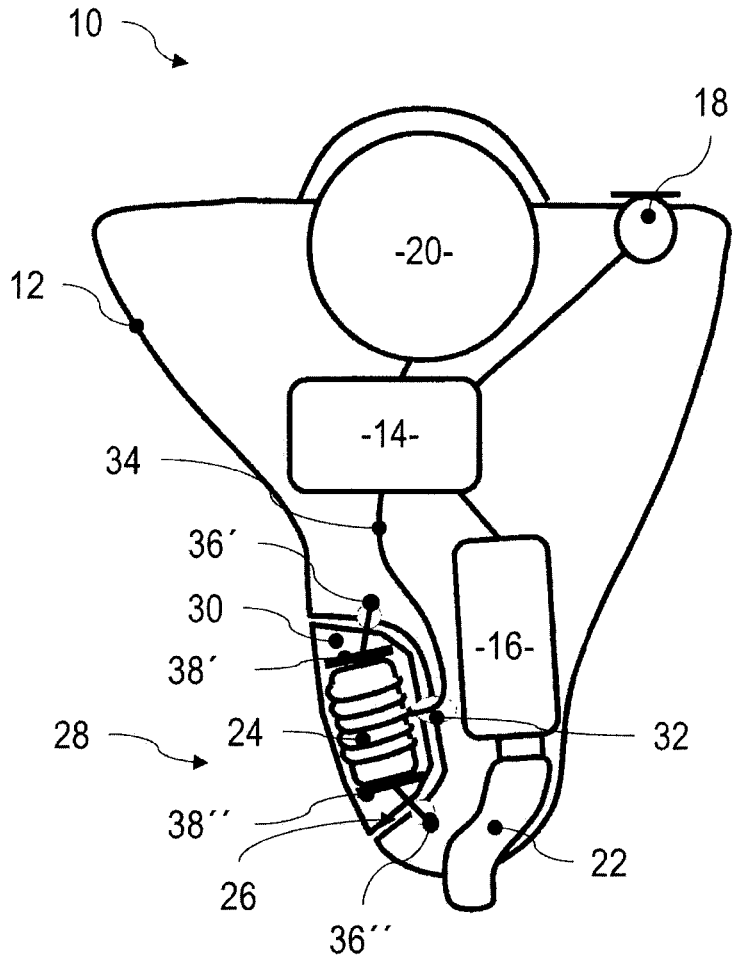
FIG. 1 schematically depicts a cross-sectional view of a hearing device according to a first aspect of the present invention.
Figure 2:
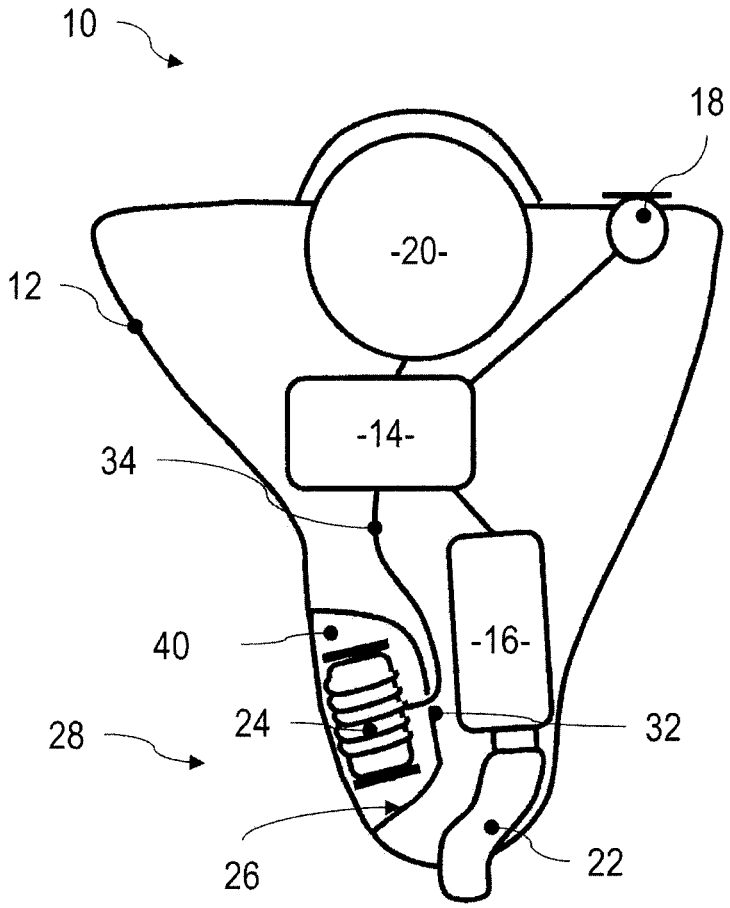
FIG. 2 schematically depicts a cross-sectional view of a hearing device according to a second aspect of the present invention.

FIGS. 1 and 2 show schematically cross-section views of a hearing device 10 in different aspects of the invention. The shown hearing device 10 is a hearing device to be worn in the hearing canal of a user, also called an In-the-Ear (ITE) hearing device. In a further example, the hearing device can be a hearing device to be worn at the ear of the user, for example a BTE hearing device with a custom shaped earpiece, a custom shaped CIC hearing device, etc.

The hearing device 10 comprises a housing 12 for accommodating a plurality of electronic components. The electronic components comprise but are not limited to a processor 14, a receiver 16, a microphone 18 and a battery 20. The acoustic output of the receiver 16 is coupled to a sound tube 22 which extends to the outside of the housing 12. The hearing device 10 further comprises an antenna 24 allowing wireless connectivity to the environment. A more detailed description of the antenna 24 will be provided in the following.

The housing 12 is made of a material which exhibits electromagnetic wave shielding characteristics, e.g. metal, in particular titan. In particular, the housing 12 is formed integrally with the electromagnetic wave shielding material such to form a Faraday cage. The housing material allows shielding against electromagnetic waves as well as to protect the hearing device 10 against the environment, e.g. against moisture, resulting in a prolonged durability of the hearing device 10. The housing 12 is formed with an indentation 26, wherein the antenna 24 is inserted into the indentation 26. In the shown examples, the indentation 26 is formed in a lower portion of the housing 12.

In the example shown in FIG. 1, the antenna 24 is comprised by an antenna module 28 which further comprises an enclosure 30 for encapsulating the antenna 24. The antenna 24 is schematically shown wound on a spool. The enclosure 30 can comprise a cast made e.g. of at least one of resin, natural rubber and silicon. The antenna 24 is integrally casted within the enclosure 30 such to be sealed against the environment. In doing so, the antenna 24 is sealed and protected against dirt, dust and moisture. It is to be noted that the material of the enclosure 30 is selected from materials which do not absorb or rather shield electromagnetic waves radiated to and/or from the antenna 24. Therefore, wireless connectivity of the hearing device 10 can be enhanced in relation to solutions in which the antenna is inserted into the housing. On the other hand, due to the housing 12 is made of the electromagnetic wave shielding material, the antenna 24 is shielded against electromagnetic waves radiated from one or more of electronic components accommodated inside the housing 12. For example, electromagnetic spikes resulting from one or more digital amplification stages of the receiver 16, which digital amplification stages drive said receiver 16, are prevented from being coupled into the antenna 24. In other words, the housing 12 acts as a Faraday cage preventing electromagnetic waves to radiate to the outside through the housing 12. Advantageously, the antenna 24 and the receiver 16 can be placed in relation to each other such that the distance is less than the distance required in prior art hearing devices. This advantage derives from the fact that the housing 12 is made of electromagnetic wave shielding material separating the antenna 24 from e.g. the receiver 16.

At least one of the advantages provided by the inventive hearing device 10 are as follows:

- Due to the housing 12 is made of metal, in particular titan, the hearing device 10 is much more durable.
- The thickness of the housing can be reduced without suffering loss of strength.
- Due to the placement of the antenna 24 outside the housing 12, electromagnetic waves radiated to and/or from the antenna 24 are not damped, shielded or rather eliminated.
- The antenna 24 is however shielded against electromagnetic waves radiated from at least one of the electronic components placed inside the housing 12. In other words, the housing 12 acts as a shielding element avoiding interference between the antenna 24 and at least one possibly interfering electronic component of the hearing device 10, for example the receiver 16.

Having regard to the above, the antenna 24 and e.g. the receiver 16 can be placed in relation to each other such that the distance thereof can be reduced as compared to prior art solutions, as long as both the antenna 24 and e.g. the receiver 16 are separated from each other by means of the housing 12 made of the electromagnetic wave shielding material.

The design factor is improved. One of a plurality of advantages resulting therefrom is a scale reduction of the hearing device as a whole.

A portion of the indentation 26 is pierced by a trough-hole 32 for passing or rather routing at least one electrical conductor 34 for electrically connecting the antenna 24 to at least one of the electronic components, for example the processor 14, a frontend, etc.

The portion of the surface of the enclosure 30 seated into the indentation 26 is shaped such to substantially mate with the contour of the indentation 26. The more precisely the enclosure 30 follows the contour of the indentation 26, the less spaces or rather gaps are created in-between. On the other hand, the portion of the surface of the enclosure 30 facing from the indentation 26 to the outside is shaped such to follow or rather align with the outline of the housing 12 once the enclosure 30 is inserted into the indentation 26.

As shown in FIG. 1, the antenna module 28 is affixed to the housing 12 (or rather to the indentation 26 thereof) by means of fixture means 36',36". Said fixture means 36',36" engage at least a portion of the housing 12, for example by means of a snap-fit connection. In doing so, at least one fixture means 36',36" snaps into respective portions of the housing 12, e.g. recesses. Of course, other means of engagement can be applied which are able to securely affix the antenna module 28 to the hearing device 10 as a whole. In an example, the antenna module 28 can further comprise at least one fixing plate 38',38" which is bonded to the enclosure 30, for example by being integrally casted into the enclosure 30. The fixing plate 38',38" comprises at least one of the fixture means 36',36". In an example, the fixing plate 38',38" and the fixture means 36',36" are integrally formed such that the fixture means 36',36" extend from the fixing plate 38',38". The snap-in connection disclosed above is adapted to simply attach the antenna module 28 to the hearing device 10 by simply pushing the antenna module 28 into the indentation 26.

In another example, while not shown, the enclosure 30 of the antenna module 28 can be glued to at least a portion of the indentation 26. In doing so, possibly spaces or rather gaps between the housing 12 and the enclosure 30 are filled with glue preventing to being filled with moisture, dust and/or dirt.

In another embodiment, as shown in FIG. 2, the antenna 24 is directly attached to the indentation 26 by means of e.g. molding. In this example, firstly the antenna 24 is placed and positioned into the indentation 26. Subsequently, the indentation 26 is simply filled with a mold 40, e.g. a glue. Once the mold 40 is cured, the surface thereof is surface-treated such to follow the contour of the housing 12. Having regard to this, the surface-treatment results in an appearance which is free of any gaps at the hearing device outline. This way of attachment allows to further completely protect the antenna 24 against the environment. Further, advantageously, the antenna 24 is mounted to the hearing device 10 easily without the creation of any spaces or gaps.

As mentioned above, the material of the housing 12 comprises a metal, in particular titan. Of course, other materials comprising electromagnetic waves shielding properties can be chosen. The antenna placement can be modelled by means of using a modelling software. The frequency of the wireless communication can be chosen to be less than 100 MHz, which allows to reduce or rather prevent absorption through human tissue. While hearing devices in the prior art use plastic housings with thicknesses of about 0.6 mm, the thickness of the metal made housing 12 of the inventive hearing device 10 can be 0.2-0.4 mm. Hence, further downsizing is allowed.

What is claimed is:

1. A hearing device to be worn in the ear of a user, said hearing device comprises a housing for accommodating an electronic component, wherein said housing is formed with an indentation, said indentation providing a space at an outer side of the housing, wherein said hearing device further comprises an antenna inserted into the indentation, wherein said housing is made of titan as an electromagnetic wave shielding material and has a thickness in the range from 0.2 mm to 0.4 mm.

2. The hearing device according to claim 1, wherein said hearing device is to be worn at least partially in the hearing canal of a user, wherein said housing is at least partially shaped according to the individual contour of the hearing canal of the user.

3. The hearing device according to claim 1, wherein the antenna is comprised by an antenna module further comprising an enclosure for encapsulating the antenna.

4. The hearing device according to claim 3, wherein the enclosure is a cast comprising at least one of resin, natural rubber and silicon.

5. The hearing device according to claim 4, wherein the antenna is integrally casted within the enclosure.

6. The hearing device according to claim 3, wherein at least a portion of the surface of the enclosure is shaped such to substantially mate with the contour of the indentation.

7. The hearing device according to claim 3, wherein at least a portion of the surface of the enclosure is shaped such to align with the outline of the housing once the enclosure is inserted into the indentation.

8. The hearing device according to claim 3, wherein the antenna module comprises a snap-in mechanism, adapted to engage at least a portion of the hearing device housing.

9. The hearing device according to claim 8, wherein the fixture means are integrally formed with a fixing plate bonded to the enclosure.

10. The hearing device according to claim 3, wherein the enclosure is glued to a portion of the housing comprising the indentation.

11. The hearing device according to claim 1, wherein the antenna is molded into the indentation.

12. The hearing device according to claim 1, wherein the housing in a portion of the indentation comprises at least one through-hole for routing at least one electrical conductor for electrically connecting the antenna to at least one of the electronic components.

13. A method for manufacturing a hearing device to be worn in the ear of a user, said method comprises the steps of:

providing a housing of the hearing device;

forming the housing with an indentation, said indentation providing a space at an outer side of the housing;

modelling, via a modelling software, placement of an antenna outside of the housing;

inserting the antenna into the indentation based on the placement of the antenna during modelling; and fixing the antenna to at least a portion of the housing comprising the indentation, wherein said housing is made of titan as an electromagnetic wave shielding material and has a thickness in the range from 0.2 mm to 0.4 mm.

14. The method according to claim 13, wherein the providing step comprises the step of shaping the housing of the hearing device such to at least partially mate with the individual contour of the hearing canal of the user.

15. The method according to claim 13, wherein the fixing step comprises the steps of:

encapsulating the antenna within an enclosure; and mounting the enclosure to the portion of the housing comprising the indentation.

16. The method according to claim 15, further comprising the step of shaping at least a portion of the surface of the enclosure such to substantially mate with the contour of the indentation.

17. The method according to claim 15, further comprising the step of shaping at least a portion of the surface of the enclosure such to substantially align with the contour of the surface of the housing once the enclosure is inserted into the indentation.

18. The method according to claim 13, wherein the fixing step comprises the steps of:

molding the antenna within the indentation by means of a mold; and surface-treating the mold such to substantially align with the contour of the surface of the housing.

* * * * *